United States Patent [19]

Hendrickson

[11] 4,390,758

[45] Jun. 28, 1983

[54] KEY-ACTUATED ELECTRICAL LOCK

[76] Inventor: Max S. Hendrickson, 1167 N. Shore Dr., Forest Lake, Minn. 55025

[21] Appl. No.: 225,752

[22] Filed: Jan. 16, 1981

[51] Int. Cl.[3] ..... H01H 27/10; H01H 27/00

[52] U.S. Cl. ..... 200/43; 200/159 B; 200/44; 70/277; 307/10 AT; 340/543; 340/825.32

[58] Field of Search ..... 200/42 R, 43, 44, 45, 200/46, 159 B, 275, 243, 264; 340/543, 825.31, 825.32, 365 R; 307/10 AT, 115; 70/277, 278, 350, 351, 352

[56] References Cited

U.S. PATENT DOCUMENTS

| | | | |
|---|---|---|---|
| 556,309 | 3/1896 | Deibert | 70/350 |
| 2,057,301 | 10/1936 | Golokow et al. | 200/42 |
| 2,868,905 | 1/1959 | Meyer | 200/44 |
| 2,905,926 | 9/1959 | Aid | 340/147 |
| 3,408,838 | 11/1968 | Katz | 70/277 |
| 3,415,087 | 12/1968 | Kramasz, Jr. et al. | 70/277 |
| 3,500,326 | 3/1970 | Benford | 340/147 |
| 3,596,014 | 7/1971 | Erez | 200/44 |
| 3,608,342 | 9/1971 | Katz | 70/271 |
| 3,728,509 | 4/1973 | Shimojo | 200/264 |
| 3,764,859 | 10/1973 | Wood et al. | 317/134 |
| 3,789,167 | 1/1974 | Seeger | 200/159 B |
| 3,801,755 | 4/1974 | Schlage | 200/44 |
| 3,819,895 | 6/1974 | Pittman et al. | 200/159 B |
| 3,860,771 | 1/1975 | Lynn et al. | 200/340 |
| 4,023,161 | 5/1977 | Sasaki | 340/365 R |
| 4,025,740 | 5/1977 | Lipschutz | 200/44 |
| 4,029,919 | 6/1977 | Lumme | 200/52 R |
| 4,146,761 | 3/1979 | Sung | 200/44 |
| 4,157,479 | 6/1979 | Chan | 307/10 AT |
| 4,164,634 | 8/1979 | Gilano | 200/159 B |
| 4,249,054 | 2/1981 | Komaki | 200/159 B |

FOREIGN PATENT DOCUMENTS

| | | | |
|---|---|---|---|
| 2708701 | 9/1978 | Fed. Rep. of Germany | 307/10 AT |

*Primary Examiner*—John W. Shepperd

*Attorney, Agent, or Firm*—Kinney, Lange, Braddock, Westman and Fairbairn

[57] ABSTRACT

A key-actuated locking device is used with a key having a plurality of spaced-apart teeth which define a pattern. The locking device includes a key passageway into which the key is inserted with predetermined orientation. A plurality of elastomeric conductors are positioned proximate the passageway and are selectively compressed by the teeth of the key when the key is inserted into the key passageway. A plurality of pairs of separated conductors are also supported by a base (such as a printed circuit board). Each conductor pair is positioned to be engaged and conductively connected by one of the elastomeric conductors when that elastomeric conductor is connected by a tooth of the key. A circuit is connected to the separated conductor pairs which permits operation of a lock mechanism when all of the proper elastomeric conductors (corresponding to the required pattern of teeth on the key) are compressed and all other elastomeric conductors are not compressed.

4 Claims, 14 Drawing Figures

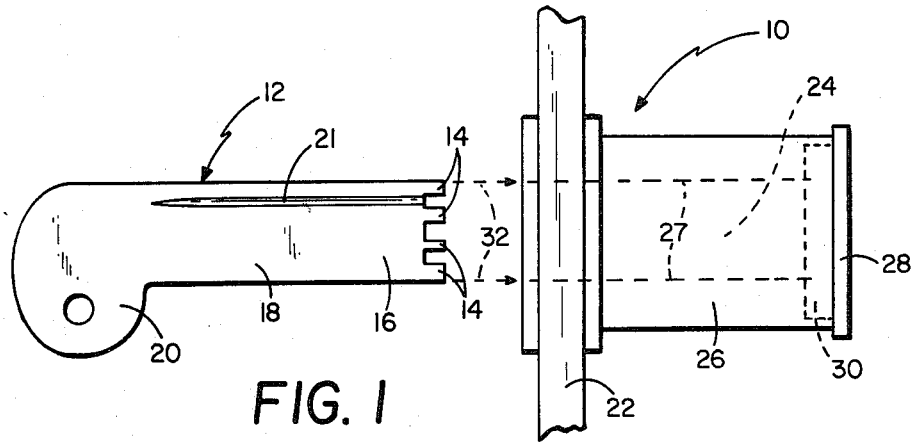
FIG. 1
FIG. 2
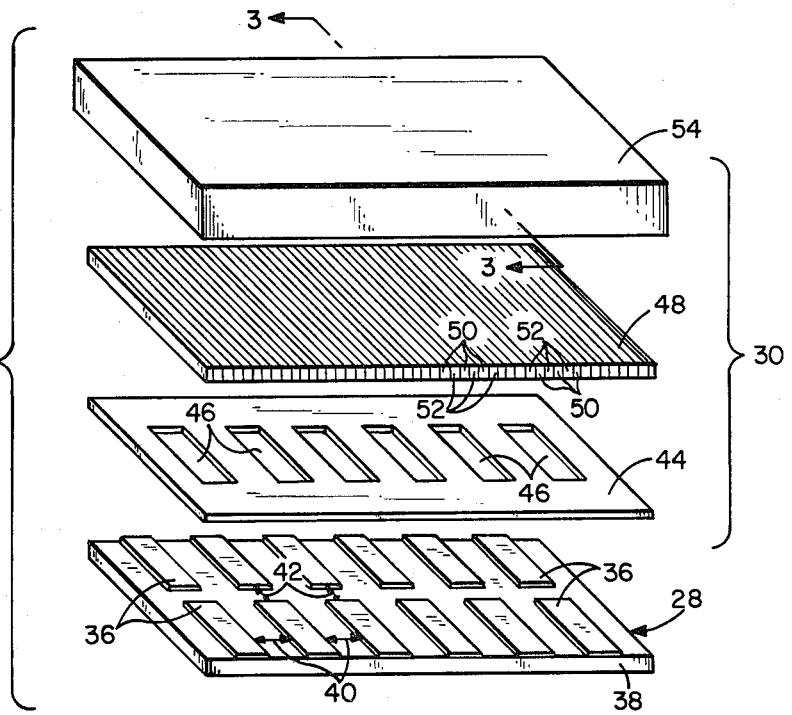
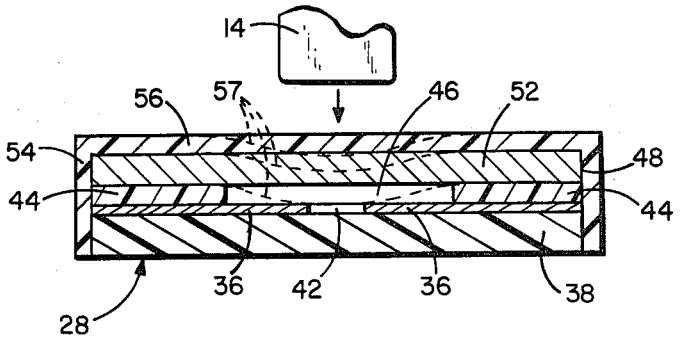
FIG. 3

KEY-ACTUATED ELECTRICAL LOCK

BACKGROUND OF THE INVENTION

1. Field of the Invention

The present invention is related to key-actuated locking devices.

2. Description of the Prior Art

Key-actuated locks having a conventional tumbler and spring mechanism that establishes an electrical contact which either electrically opens the lock or sets off an alarm are generally well-known in the prior art. These types of locking devices are described in considerable detail in the following patents.

| | | |
|---|---|---|
| Golokow et al. | U.S. Pat. No. | 2,057,301 |
| Aid | | 2,905,926 |
| Katz | | 3,408,838 |
| Kramasz et at. | | 3,415,087 |
| Erez | | 3,596,014 |
| Katz | | 3,608,342 |
| Wood et al. | | 3,764,859 |
| Schlage | | 3,801,755 |
| Sasaki | | 4,023,161 |
| Lipschutz | | 4,025,740 |
| Lumme | | 4,029,919 |
| Sung | | 4,146,761 |
| Chan | | 4,157,479 |

The Golokow et al. U.S. Pat. No. 2,057,301 describes a lock that completes an alarm circuit when an improper key is placed in the lock. The forward serrated edge of the improper key pushes the last tumbler of the lock which completes the alarm circuit. The proper key has a forward cut-out that avoids pushing up the last tumbler and avoids completing the alarm circuit. The Lumme U.S. Pat. No. 4,029,919 also achieves this feature with angular movement of the inner cylinder of a rotatable lock.

The Aid U.S. Pat. No. 2,905,926 describes a key-actuated device that has spring biased tumblers which act as switches for permitting access to the key holder while also identifying the key holder.

The Katz Pat. No. 3,408,838 describes tumblers in a key-actuated lock that have conductive rings. When the conductive rings are aligned, they complete a door unlocking circuit.

The Kramaz et al. U.S. Pat. No. 3,415, 087 describes a key-actuated lock that when rotated closes through its serrated edges predetermined switches which are connected to a logic circuit. The logic circuit determines whether access is permitted to the key holder.

The Erez U.S. Pat. No. 3,596,014 describes a "Yale-type" lock with tumblers having a conductive strip positioned on a side of the tumblers opposite the key. If an incorrect key is placed in the lock, the key through its improperly positioned serrated edges causes one of the tumblers to come in contact with the conductive strip, placing the lock in an alarm mode. A correct key does not allow the tumblers to contact the strip.

The Katz U.S. Pat. No. 3,608,342 describes a tumbler/spring operated door lock which electrically actuates, through conducting tumblers, an electrically actuated door latch.

The Wood et al. U.S. Pat. No. 3,764,859 describes a similar lock for an automobile. The tumblers have conductive surfaces and tumbler receptacles have conductive linings, together forming switches. When the proper switches are turned on, forming a proper code, an electrical circuit allows oil to flow to the transmission by way of a solenoid valve, enabling the automobile to run.

The Schlage U.S. Pat. No. 3,801,755 also describes a tumbler/spring actuated lock. The spring, upper tumblers, rotating inner cylinder and a conductor attached to one end of the spring complete a circuit that places the lock in an open mode when the tumblers are placed in alignment, thus allowing the inner cylinder to be moved angularly. The Saski U.S. Pat. No. 4,023,161 similarly describes a lock which has a key which when inserted closes the proper switches defining the proper code, permitting access to the user. The key is cylindrical and has a plurality of grooves of varying lengths which cooperate with push pins in the lock forming the switches. A binary code is established and identifies the key user.

The Lipschutz U.S. Pat. No. 4,025,740 describes a tumbler lock that accepts a cylindrical key having a driver of non-circular cross-sectional shape. The key, when turned in an angular direction, will ensure that at least one device essential for the operation of a motor vehicle is placed in an operational mode by way of a cooperating electrical circuit.

The Sung U.S. Pat. No. 4,146,761 describes a key-actuated electric lock having a distal end portion which activates an electric circuit after spring-biased tumblers are aligned and the inner cylinder is allowed to move angularly.

The Chan U.S. Pat. No. 4,157,479 describes a key having resistors that are connected to other resistors within a lock. When the key is inserted a bridge circuit is formed. A sensing branch of the bridge circuit is coupled to an anti-theft switch in a car, and in the event that current flows through the sensing branch, the anti-theft switch is opened preventing activation of the starter motor of the car.

Some of the above-mentioned patents use a switching mechanism which takes a considerable amount of space, either in the form of the traditional tumbler mechanism or a separate switch. Typically, the operable portion of a lock has a very limited amount of space limiting the size of the key needed to open the lock. A separate switch to electrically actuate the lock adds a considerable cost to the lock. All of the above-mentioned patents use switching mechanisms which have metal components that are subject to wear and corrosion over a long period of time. Mechanical tolerances become a significant problem with these types of switching mechanisms, since both the keys and the switching mechanism are subject to wear.

The Benford U.S. Pat. No. 3,500,326 describes a mechanically programmed encoder system. As a key with serrated edges is placed in the key passageway of the lock, the serrated edges pass a sensor within the lock. The sensor transmits signals in the form of a code to a programmed decoder system. The decoder system receives and analyses the code and allows access to the user. The transmitter may be either a pair of switches, photocells or any other type of device that can detect the serrated edges of the key as the edges pass by. In addition, the serrated edges may also be placed on the outer surface of a cylindrical key which when turned angularly passes the serrated edges past the sensor.

SUMMARY OF THE INVENTION

The present invention is a key-actuated locking device that is actuated with a key having a plurality of spaced-apart teeth which define a pattern. The key-actuated locking device includes a key passageway into which the key is inserted with a predetermined orientation. A plurality of elastomeric conductors are positioned with respect to the key passageway so that they are selectively compressed by the teeth of the key when the key is inserted in the key passageway. A plurality of pairs of separated conductors are supported by a base proximate the plurality of elastomeric conductors. Each pair of separated conductors is positioned to be engaged and conductively connected by a corresponding elastomeric conductor when that elastomeric conductor is compressed by a tooth of the key. When the proper predetermined elastomeric conductors are compressed and all the other elastomeric conductors not compressed, a circuit provides a signal which places the locking device in the open mode.

Locking devices, in general, have a limited amount of space available for switching mechanisms which control the opening of the locking device. The elastomeric conductors of the present invention fit into extremely small spaces. In addition, elastomeric conductors are both inexpensive and reliable and are relatively impervious to corrosive atmospheric effects. The teeth of the key can either directly or indirectly through some intermediate member compress the elastomeric conductors completing the circuit in a simple and previously unknown manner in locking devices. Because the elastomeric conductors are compressible, mechanical tolerance problems can be alleviated.

BRIEF DESCRIPTION OF THE DRAWINGS

FIG. 1 is a side view of a key positioned to be inserted in one embodiment of a locking device of the present invention.

FIG. 2 is an exploded perspective view of one embodiment of the elastomeric conductor switching mechanism of the present invention.

FIG. 3 is a cross-sectional view of the embodiment of the switching mechanism shown in FIG. 2 taken along section 3—3.

DETAILED DESCRIPTION OF THE PREFERRED EMBODIMENTS

Figure 4:
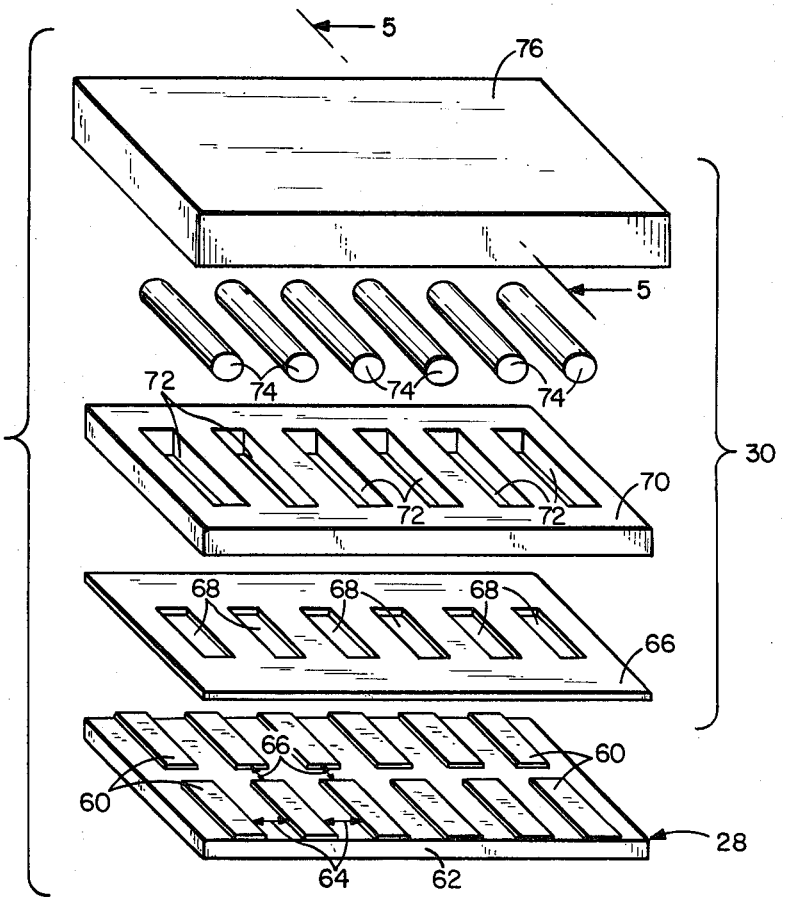
FIG. 4 is an exploded perspective view of another embodiment of the elastomeric conductor switching mechanism of the present invention.

One preferred embodiment of key-actuated locking device 10 of the present invention is illustrated in FIG. 1. Key-actuated locking device 10 is actuated by key 12 having a plurality of spaced apart teeth 14 which are positioned in a particular pattern. In the embodiment shown in FIG. 1, teeth 14 are located at forward end 16 of key 12, which has main body 18 that is integral with handle 20. Main body 18 has an orientation groove 21 which determines the orientation of key 12. It should be understood that although groove 21 is specifically shown, other orientation means such as a protruding section are also contemplated.

Key-actuated locking device 10 is mounted to and extends through support 22, which is typically a wall. The wall in turn may be part of a panel board of an electronic instrument, a wall of a room, or any other wall proximate an area into which limited access is desired.

In the embodiment shown in FIG. 1, device 10 includes key passageway 24 and outer casing 26. Inner walls 27 of outer casing 26 define key passageway 24, which is complementary to main body 18 and groove 21 to properly orient key 12 within device 10 of the present invention. Printed circuit board 28 forms the rearward end of locking device 10. Elastomeric conductor switching mechanism 30 (generally indicated by broken lines) is positioned at the end of passageway 24 adjacent circuit board 28 and is engaged by teeth 14 upon insertion of key 12. Key 12 is inserted into key passageway 24 along the general direction indicated by broken-line arrows 32. Key 12 is simply inserted into key passageway 24 and teeth 14 are pressed against elastomeric conductor switching mechanism 30, which in turn is compressed against printed circuit board 28.

To more fully understand the present invention, several embodiments of elastomeric conductor switching mechanism 30 will now be described. In FIGS. 2 and 3, a preferred embodiment of elastomeric conductor switching mechanism 30 and printed circuit board 28 is illustrated in exploded view and cross-sectional view, respectively. In this particular embodiment, printed circuit board 28 has a plurality of separated metal conductive strips 36 positioned on base 38. Preferably, separated strips 36 are metallization runs of printed circuit board 28. Separated conductive strips 36 are separated into pairs by gaps 40 in one direction and each pair is separated by gap 42 in an opposite direction. Insulator spacer sheet 44 has a plurality of spaced apart apertures 46. Each aperture 46 is arranged to be positioned over a pair of separate strips 36 and corresponding gap 42. Spacer 44 is preferably made of a flexible synthetic polymer with insulating characteristics, such as polyethylene terephthalate made by the E. I. DuPont deNemours Co. and sold under the trademark "Mylar".

Elastomeric conductive composite sheet 48 is positioned directly above spacer 44. Composite sheet 48, commonly referred to as a "zebra board", is placed directly on spacer 44. Spacer 44 spaces zebra board 48 from circuit board 28 and acts as an insulator. Zebra board 48 is a sheet formed of both nonconductive elastomeric strips 50 and conductive elastomeric strips 52 in alternating adjacent positions. Nonconductive elastomeric strips 50 are preferably made of a conventional elastomer such as silicone rubber. Conductive elastomeric strips 52 are made from a conductive elastomer having conductive particles dispersed within the elastomer which make the elastomer conductive. Such conductive elastomers are well-known and have been described in various articles. One elastomer currently used in producing the conductive strips is a silicone rubber and has been described in *Electronic Packaging and Production*, pages 237–250 (July 1890), and *Electronic Design*, pages 105–109 (June 21, 1980).

Protective cover 54, made of a flexible material, covers zebra board 48, spacer 44 and the side of circuit board 28 containing the separated conductor strips 36. Cover 54 protects these components from the elements, and also the conductive elastomeric strips 52 from wear caused by direct engagement by teeth 14. Outer surface 56 of cover 54 is a surface adjacent the end of key passageway 24. As illustrated in FIG. 3, aperture 46 and spacer 44 define a gap between conductive elastomeric strips 52 and separated conductors 36. When key 12 is inserted into key passageway 24, teeth 14 are pressed against outer surface 56. The pressure from teeth 14 flexes protective cover 54 which compresses zebra board 48 and at least one conductive elastomeric strip 52 (as indicated by broken lines 57) against separated conductors 36 to make electrical connection between conductors 36.

Figure 5:
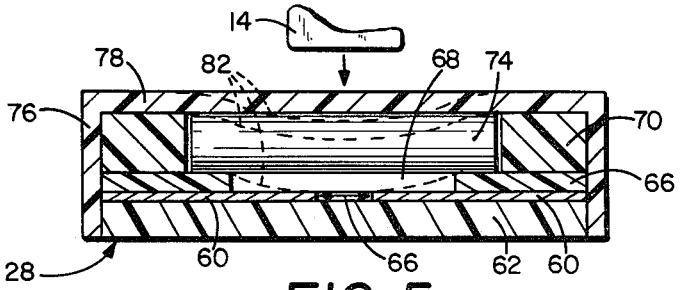
FIG. 5 is a cross-sectional view of the embodiment of FIG. 4 taken along the section 5—5.

Another embodiment of conductive elastomeric switching mechanism 30 is shown in FIGS. 4 and 5. In this embodiment, printed circuit board 28 has separated conductor strips 60 on base 62. As in the previous embodiment shown in FIGS. 2 and 3, the conductor strips 60 are separated into pairs by gaps indicated by arrows 64, and each pair is separated by a gap indicated by arrows 66.

Insulating spacer sheet 66 has spaced apart apertures 68 which are spaced apart approximately the same distance as gaps 64 between adjacent pairs of conductive strips 60. Spacer 66 is made of similar material as spacer 44 shown in FIGS. 2 and 3. Spacer 66 is positioned adjacent to circuit board 28 so that each aperture 68 is aligned with a corresponding pair of separated conductive strips 60.

Positioning member 70 is located adjacent spacer 66 on the opposite side of spacer 66 from circuit board 28. Positioning member 70 has a plurality of spaced-apart positioning cavities 72 which are aligned with apertures 68 and separated pairs of conductive strips 60. Cavities 72 are larger in at least one dimension (e.g. longer in length) than apertures 68 in the spacer 66. Positioning member 70 is made of a nonconductive material, such as Mylar, and is preferably an integral unit.

A plurality of conductive elastomeric rods 74 of cylindrical configuration are located within cavities 72. Although rods 74 are preferred, any configuration that permits placement of a conductive elastomer within cavities 72 is contemplated in accordance with the present invention.

Conductive elastomeric rods 74, when placed within cavities 72, have their longitudinal axes positioned along the longitudinal axes of cavities 72 and substantially fill cavities 72. Conductive elastomeric rods 74 lie on top of spacer 66 since the rods 74 are larger than apertures 68. In this manner, each conductive elastomeric rod 74 is spaced from a corresponding pair of separated conductive strips 60 by spacer 66 and the gap defined by aperture 68. Conductive elastomeric rods 74 of the embodiment shown in FIGS. 4 and 5 are preferably made of a silicone rubber having a dispersed conductive material therein, as described in the articles previously mentioned.

Protective cover 76 encloses positioning member 70 with conductive elastomeric rods 74, spacer 66 and a surface of printed circuit board 28. Protective cover 76 is made of a flexible nonconductive material. As illustrated in FIG. 5, aperture 68 and spacer 66 define a gap between conductive elastomeric rod 74 and a corresponding pair of separated conductive strips 60. As described previously with reference to FIG. 1, conductive elastomeric switching mechanism 30 and printed circuit board 28 of FIGS. 4 and 5 are located at the rearward end of key passageway 24 of key-actuated locking device 10. Mechanism 30 is positioned so that outer surface 78 of protective cover 76 is adjacent the key passageway 24 for contact with teeth 14 when key 12 is inserted into key passageway 24. Teeth 14, when pressed against outer surface 78, cause flexing of protective cover 76 to compress conductive elastomeric rods 74 inwardly into apertures 68. These elastomeric conductive rods 74 which are pressed through apertures 68 contact separated conductive strips 60, as shown by broken lines 82 in FIG. 5, to make an electrical connection.

Figure 6:
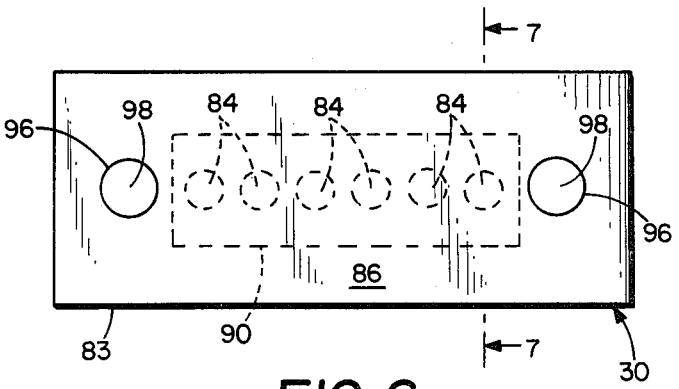
FIG. 6 is a top view of another embodiment of the switching mechanism of the present invention showing the position of the elastomeric conductors.
Figure 7:
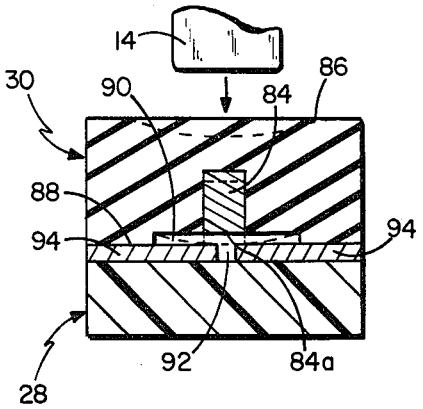
FIG. 7 is a cross-sectional view illustrating the position of elastomeric conductors with respect to separated conductors positioned on a base taken along section 7—7 in FIG. 6.

Another embodiment of the elastomeric conductor switching mechanism 30 is illustrated in FIGS. 6 and 7. Mechanism 30 comprises elastomeric carrier 83 with a plurality of embedded conductive buttons 84. Carrier 83 has an outer surface 86 which is engaged by teeth 14 of key 12, and an inner surface 88 which is mounted on printed circuit board 28. Inner surface 88 of character 83 includes cavity 90, which overlies gaps 92 of conductor run pairs 94 on circuit board 28. Each conductive button 84 has its lower surface **84*a* exposed at cavity 90. As a result, carrier 83 acts as a composite support, spacer, and protective cover for conductive buttons 84**.

When key 12 is inserted in keyway 24, individual teeth 14 engage top surface 86 of carrier 83. This causes carrier 83 to be compressed at selected positions, thereby bringing surfaces **84*a* of selected conductive buttons 84 into physical and electrical contact with their corresponding conductor pairs 94. As a result, electrical connection between selected conductor pairs 94 is provided by teeth 14 of key 12**.

As shown in FIG. 6, carrier 83 preferably has a pair of alignment holes 96 which cooperate with alignment pins 98 to properly align carrier 88 and buttons 84 with printed circuit 28.

In one preferred embodiment of the present invention, conductive buttons 84 are silver filled elastomeric buttons having a diameter of about 0.030 inches which are positioned on 0.050 centers. Conductors 94 in this embodiment have a width of 0.025 inches, and each pair of conductors 94 has a gap of about 0.015 inches. The spacing between adjacent pairs of conductors 94 is about 0.025 inches. The particular size and spacing of conductive buttons 84 and conductors 94 depends, of course, upon the configuration of teeth 14 on key 12.

From the above discussion, it can be easily understood that the elastomeric conductors of mechanism 30 may come in various shapes and can be positioned and retained by numerous methods. The elastomeric conductors can be placed along a linear axis as shown in the Figures or can be arranged in a circular pattern for use in a cylindrical locking device such as an "Ace" lock; that is engaged by a cylindrical key having teeth at a distal end.

Since conductive elastomeric conductors are elastomeric and are compressible, the conductors provide a locking device with tolerances as large as plus or minus 0.010 inch. This is extremely advantageous since the compressibility of the conductors permits wear and manufacturing tolerances to be accommodated to much greater extent than has been possible with prior art locking devices.

The elastomeric conductors can be made presently at a cost of approximately $0.003 each, which is compatable with the production of a relatively inexpensive lock. In combination with a printed circuit board, spacing can be achieved between conductive elastomeric conductors as close as 0.025 inches, which is much closer than any existing conventional lock having a tumbler mechanism.

Figure 8:
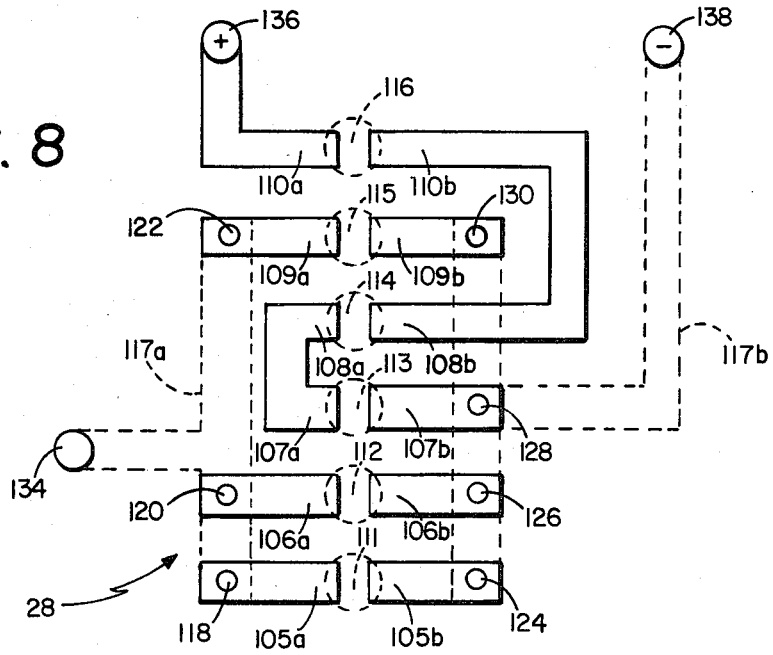
FIG. 8 is a plan view of one embodiment of the separated conductors which are used with the elastomeric switching mechanism of the present invention.

FIG. 8 illustrates a plan view of circuit board 28 used in one preferred embodiment of the locking device of the present invention. On its front surface, circuit board 28 has separated pairs of conductive runs 105*a* and 105*b*, 106*a* and 106*b*, 107*a* and 107*b*, 108*a* and 108*b*, 109*a* and 109*b*, and 110*a* and 110*b*. Positioned over and normally spaced from the gaps between the separated pairs of conductive runs are elastomeric conductors 111–116. Elastomeric conductor 111 is positioned over the gap between conductive runs 105*a* and 105*b*; elastomeric conductor 112 is positioned over the gap between conductive runs 106*a* and 106*b*; and so on. Elastomeric conductors 111–116 are normally spaced from the front surface of circuit board 28, as previously illustrated in the embodiments shown in FIGS. 2 through 7, and are selectively brought into contact with the conductive runs upon pressure from teeth 14 of key 12.

Located on the back surface of printed circuit board 28 (and shown in broken lines) are conductive runs 117*a* and 117*b*. Connections are made between conductive runs on the front and back surface by plated-through holes 118, 120, 122, 124, 126, 128 and 130. Plated-through holes 118, 120 and 122 connect conductive runs 105*a*, 106*a* and 109*a*, respectively, with conductive run 117*a*. Similarly, plated-through holes 124, 126, 128 and 130 connect conductive runs 105*b*, 106*b*, 107*b* and 109*b* to conductive run 117*b*.

In the embodiment of circuit board 28 shown in FIG. 8, conductive terminal pins 134, 136 and 138 provide connection between the conductive runs of printed circuit board 28 and external circuitry of the locking device. Terminal 134 is connected to conductive run 117*a*; terminal 136 is connected to conductive run 110*a*; and terminal 138 is connected to conductive run 117*b*.

In the embodiment shown in FIG. 8, conductive runs 107*a* and 108*a* are connected together, and conductive run 108*b* is connected to conductive run 110*b*. As a result, the switches formed by elastomeric conductors 113, 114 and 116 (and their associated conductive runs) are connected in series between terminals 136 and 138. The switches formed by elastomeric conductors 111, 112 and 115 (and their associated conductive runs) are connected in parallel between terminals 134 and 138. As a result, elastomeric conductors 113, 114 and 116 must all be engaged by teeth 14 of key 12 in order to provide a conductive connection between terminals 136 and 138. On the other hand, conductive connection between terminals 134 and 138 is achieved if any one of elastomeric conductors 111, 112 or 115 is engaged by teeth 14 of key 12.

Figure 9:
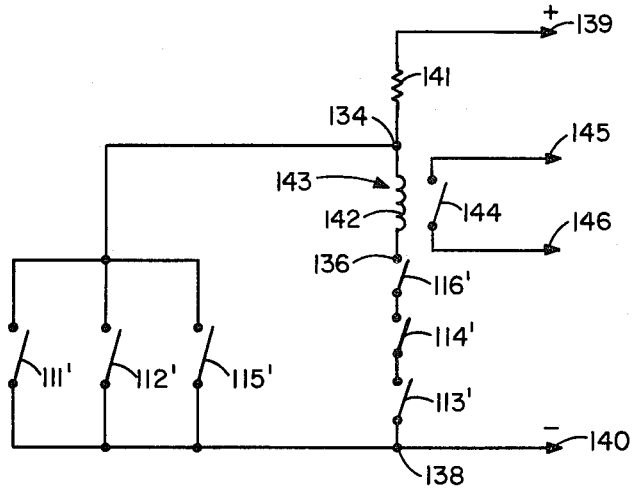
FIG. 9 is a schematic view of one type of circuit that is used in the locking device of the present invention.

FIG. 9 is an electrical schematic diagram illustrating a circuit utilizing the switching device illustrated in FIG. 8. In the circuit of FIG. 9, power is supplied at positive and negative supply terminals 139 and 140. Resistor 141 is connected between positive supply terminal 139 and terminal 134. Coil 142 of relay 143 is connected between terminals 134 and 136. Terminal 138 is connected to negative supply terminal 140. Relay contacts 144 of relay 143 are connected to output terminals 145 and 146.

As shown in FIG. 9, switches 113', 114' and 116' (formed by elastomeric conductors 113, 114 and 116 and their associated conductive runs 107, 108 and 110) are connected in series with coil 142 between terminals 134 and 138. For coil 142 to be energized, therefore, all three switches 113', 114' and 116' must be closed. Switches 111', 112' and 115' (formed by elastomeric conductors 111, 112 and 115 and corresponding conductive runs 105, 106 and 109) are connected in parallel between terminals 134 and 138. If any one of these three switches is closed, it will shunt current flow between terminals 134 and 138, and will prevent coil 142 from being energized, regardless of the state of switches 113', 114' and 116'.

The circuit of FIG. 9, therefore, permits coil 142 to be energized only when the proper combination of teeth 14 are present on key 12. If any one of the switches which must be closed (i.e. switches 113', 114' and 116') is not closed, or if any of the three switches which must be open (i.e. switches 111', 112' and 115') is closed, this indicates an improper key, and prevents coil 142 from being actuated.

Figure 10:
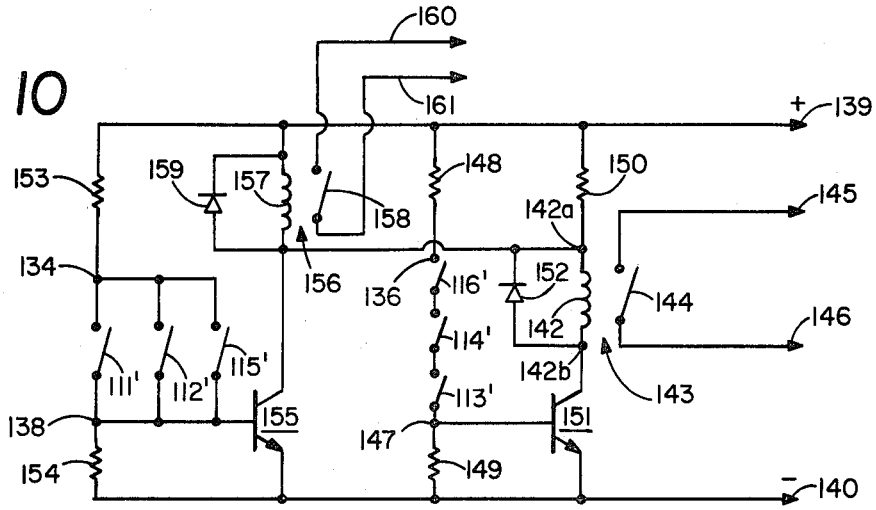
FIG. 10 is a schematic view of still another type of circuit which includes a "tamper" alarm.

The circuit of FIG. 9 is particularly advantageous when the contact resistance of switches 111–116 is low (preferably on the order of a few ohms when in the "closed" state). FIG. 10 shows an electrical schematic diagram of another circuit which is usable when switches 111'–116' have higher closed contact resistance (for example on the order of 100 ohms). The circuit of FIG. 10 is usable with the embodiment of circuit board 28 shown in FIG. 8, except that plated-through connector 128 is not provided, and a separate terminal 147 is connected to conductive run 107*b*.

In the circuit of FIG. 10, power is again supplied between power supply terminals 139 and 140. Resistors 148 and 149 and switches 113', 114' and 116' form a series current path between terminals 139 and 140. Resistor 148 is connected between terminal 139 and terminal 136. Resistor 149 is connected between terminal 147 and terminal 140.

Coil 142 of relay 143 is connected in a series current path between terminals 139 and 140 which includes resistor 150 and NPN transistor 151. Resistor 150 is connected between terminal 139 and terminal 142*a* of coil 142. The collector-emitter current path of transistor 151 is connected between terminal 142*b* and terminal 140. The base of transistor 151 is connected to terminal 147. Diode 152 is connected in parallel with coil 142 to provide flyback protection.

Switches 111', 112' and 115' are connected with resistors 153 and 154 in a current path between terminals 139 and 140. Resistor 153 is connected between terminal 139 and terminal 134, and resistor 154 is connected between terminal 138 and terminal 140. Switches 111', 112' and 115' control the conductive state of NPN transistor 155, which has its base connected to terminal 138 and its collector-emitter current path connected between terminal 142*a* of coil 142 and supply terminal 140.

Also shown in FIG. 10, a tamper alarm circuit is provided by relay 156 (which includes coil 157 and contacts 158), diode 159, and tamper alarm output terminals 160 and 161. Coil 157 is connected between terminal 139 and the collector of transistor 155. Relay contacts 158 are connected between output terminals 160 and 161. Diode 159 is connected in parallel with coil 157 to provide flyback protection.

When the proper key is inserted, switches 113', 114' and 116' are all closed (i.e. conductive). This turns on transistor 151, which energizes coil 142 to close contacts 144. When the proper key is inserted, switches 111', 112' and 115' all remain open, so that transistor 155 is turned off. As a result, coil 157 remains deenergized.

If an improper key is inserted, or someone is tampering with the locking device so that one of the switches 111', 112' or 115' is closed, transistor 155 turns on. When turned on, transistor 155 shunts the current flow through coil 142, thus deenergizing coil 142 and preventing contacts 144 from being closed. In addition, the turning on of transistor 155 energizes coil 157, which closes contacts 158. This provides a signal at tamper alarm output terminals 160 and 161 which may be used, for example, to provide an alarm signal indicating that an improper key is being inserted, or that tampering with the locking device is taking place.

The circuits of FIGS. 9 and 10 are but samples of the many various circuits that can be used with the elastomeric conductors of the present invention. As is easily understood from the figures, the number of elastomeric conductors and corresponding separated conductors can be varied in countless combinations.

Figure 11:
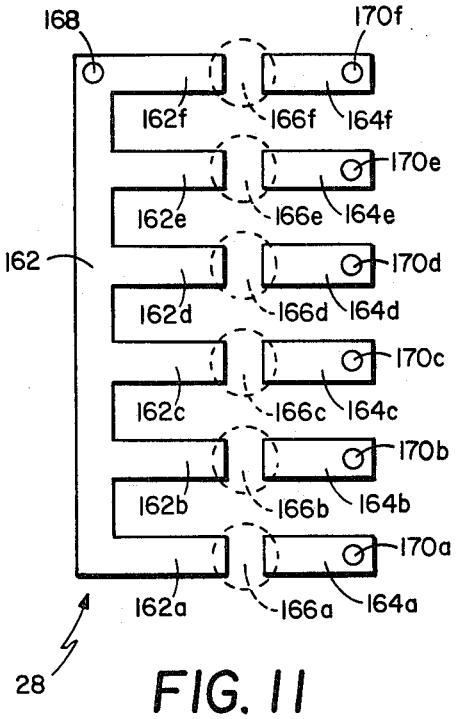
FIG. 11 is a plan view of yet another embodiment of the elongated switching mechanism of the present invention.
Figure 12:
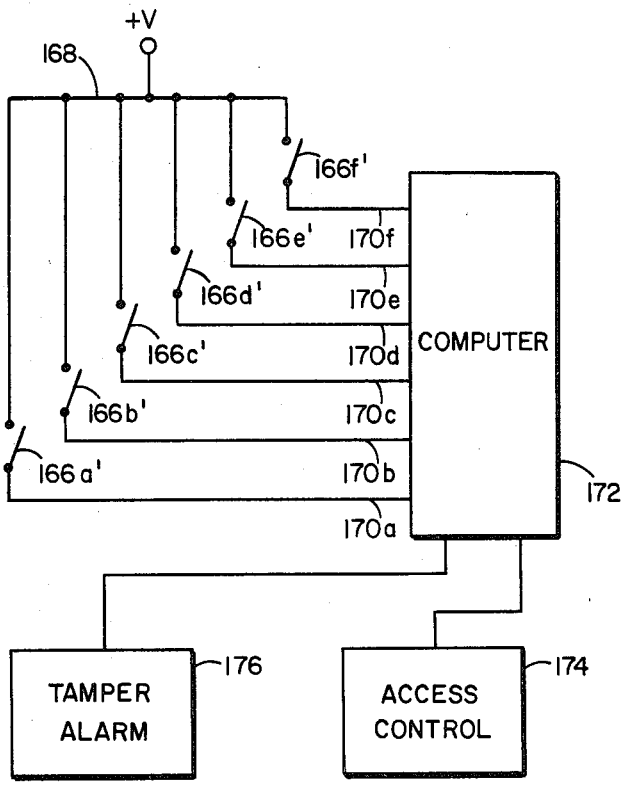
FIG. 12 is a schematic view of yet another embodiment of a circuit used in the present invention.

Another embodiment of circuit board 28 in plan view is shown in FIG. 11 with an accompanying electrical schematic diagram shown in FIG. 12.

The embodiment of circuit board 28 shown in FIG. 11 includes common conductive run 162, which has six individual fingers 162*a*–162*f*. Spaced from conductive fingers 162*a*–162*f*. Elastomeric conductors 166*a*–*166f* (shown in broken lines) are spaced above the gaps between conductive run fingers 162*a*–162*f* and individual conductive runs 164*a*–164*f*, respectively. Common terminal 168 is connected to conductive run 162, and terminals 170*a*–170*f* are connected to conductive runs 164*a*–164*f*, respectively.

As shown in FIG. 12, terminal 168 is connected to the positive supply voltage (+V) and terminals 170*a*–170*f* are connected to computer 172.

Switches 166*a'*–166*f'* (which are formed by elastomeric conductors 166*a*–166*f* and associated conductive runs) are fed in parallel to the inputs of computer 172.

The user has a key which has teeth designed to compress only certain elastomeric conductors thereby defining a particular code. When the key is inserted into the key-actuated locking device, the teeth compress desired elastomeric conductors and a code in the form of the states of switches 166*a'*–166*f'* is transmitted to computer 172. Computer 172, which is for example a microcomputer, interrogates the status of switches 166*a*–166*f'*, decodes the code received, and either provides a signal to access control 174 or to tamper alarm 176.

The particular embodiment of FIGS. 11 and 12 provides a key-actuated locking device with great flexibility due to the computing power of computer 172. For example, each user may have his own particular key which uniquely identifies that user, and computer 172 grants or refuses access to that user. This is of particular desirability in limited access areas where there are a number of users, each of which has a key. If one of the keys is lost or stolen, the computer need only be programmed not to provide access to the lost key. The user who lost the key may be issued a different one without having all the keys held by all the users changed to ensure limited across into the controlled area.

Figure 14:
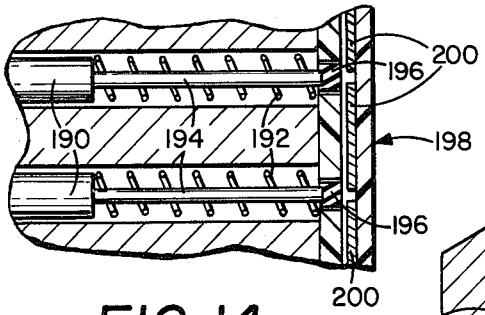
FIG. 14 is an enlarged fragmentary cross-sectional view of two tumbler/spring mechanisms and the elastomeric conductors of the present invention with parts shown whole for purposes of clarity.
Figure 13:
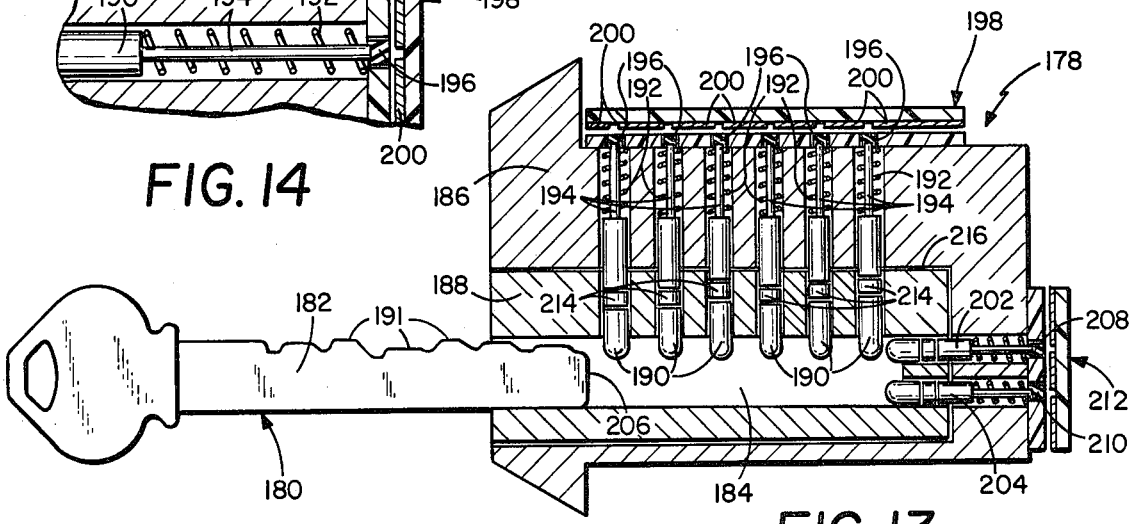
FIG. 13 is a cross-sectional view of another embodiment of the locking device of the present invention illustrating the use of elastomeric conductors in cooperation with spring biased tumblers with parts shown whole for purposes of clarity.

Still another embodiment of the present invention is shown in FIGS. 13 and 14. Key-actuated locking device 178 is shown with key 180 partially inserted therein. Key 180 is preferably a conventional key and has main body 182 which is preferably flat in the vertical direction and conforms to the cross-sectional configuration of key passageway 184 so that key 180 is inserted in a predetermined orientation. Key-actuated locking device 178 is similar to a "Yale-type" rotating lock, and is intended for use as a replacement for this type of lock. Device 178 includes outer casing 186 and inner rotating cylinder 188. A plurality of tumbler pins 190 extend into the passageway to engage, at one end, serrated edges or teeth 191 of main body 182 of key 180 when key 180 is inserted in passageway 184. Each tumbler pin 190, at its other end, has a rod-like member 192 attached thereto. Rods 192 are circumferentially surrounded by springs 194 which bias tumbler pins 190 into key passageway 184. At the free end of each rod 192 is elastomeric conductor 196 which is spaced from circuit board 198. In the embodiment shown in FIGS. 13 and 14, elastomeric conductors 196 are attached to the ends of rods 192, and springs 194 provide a bias force which normally maintains elastomeric conductors 196 spaced from circuit board 198. The spacers shown in previous embodiments, however, are also applicable to a locking device of the type shown in FIGS. 13 and 14.

Circuit board 198 has conductive runs 200 positioned on a side facing the elastomeric conductors 196. Conductive runs 200 and elastomeric conductors 196 form switches indicating the presence or absence of individual teeth 191 of key 180.

Preferably, two other tumbler mechanisms 202 and 204, similar in construction to the tumbler mechanisms just described, are positioned at the end of key passageway 184 to contact distal end 206 of key 180. When the key is inserted fully into key passageway 184, distal end 206 engages tumblers 202 and 204. Tumblers 202 and 204, each through their conductive elastomeric conductors 208 and 210 complete a circuit on circuit board 212 which turns on power to circuit board 198. Tumbler pins 202 and 204 are placed in the key passageway to switch on circuit board 198 only after key 180 has been inserted to ensure that the proper serrated edges 191 of key 180 are in contact with the proper tumbler pins 190. If the proper key has been inserted in key passageway 184, tumbler pin portions 214 are aligned with the outer surface 216 of inner cylinder 188. Thus, inner cylinder 188 can be turned to mechanically open the lock and, since the proper elastomeric conductors 196 are compressed, a solenoid (not shown) is activated. When deactivated, the solenoid (not shown) preferably retains a latch (not shown) in a closed position, and when activated it releases the latch (not shown) so that the latch (not shown) may be opened by turning the inner cylinder 188.

It should be understood that in other embodiments locking device 178 does not have to have an inner turning cylinder. In one embodiment without an inner turning cylinder, the key is inserted into the key passageway. If the proper elastomeric conductors are compressed, a solenoid is activated that electronically opens a latch and places the locking device in an open mode.

In conclusion, the locking device of the present invention provides a reliable electrical key-actuated switch that is inexpensive and will easily fit into the limited space available in a locking device. The elastomeric conductors greatly ease tolerance requirements and accommodate key wear, because the elastomeric conductors are compressible.

Although the present invention has been described with reference to the preferred embodiments, persons skilled in the art will recognize that changes may be made in form and detail without departing from the spirit and scope of the invention.

What is claimed is:

1. A key-actuated locking device comprising:

a key having a handle, a flat longitudinal main body attached to the handle, a row of closely spaced apart teeth at a distal end of the main body defining a predetermined pattern from among a plurality of possible different patterns, and orientation means carried by the main body for defining a predetermined orientation of the row of teeth;

a longitudinal key passageway into which the key is inserted, the key passageway cooperating with the orientation means so that the row of teeth have the predetermined orientation;

a circuit board positioned in a first plane adjacent and perpendicular to an end of the key passageway and having a plurality of pairs of separated conductors thereon defining a row of closely spaced apart locations corresponding to possible positions of the spaced apart teeth of the key for a plurality of possible different patterns, including the predetermined pattern;

an insulator sheet positioned adjacent to the circuit board and between the circuit board and the key passageway, the insulator sheet having a plurality of openings, each opening aligned with at least one of the closely spaced locations defined by the separated conductors;

a plurality of elastomeric conductors positioned between the key passageway and the insulator sheet, at least one elastomeric conductor being aligned with each closely spaced location defined by the pairs of separated conductors, each elastomeric conductor having a first surface for receiving force supplied by a tooth of the key and a second surface for engaging and electrically connecting the pair of separated conductors with which it is aligned, so that when force is applied to the first surface of the elastomeric conductor, its second surface is brought into engagement and electrical contact with the pair of separated conductors with which it is aligned, and wherein the elastomeric conductor is resilient and compressible so that application of force by the tooth which is greater than needed to bring the second surface into engagement with the pair of separated conductors causes compression of the elastomeric conductor without damage to the circuit board, the pair of separated conductors, or the key; and means connected to the conductors and actuated when only the pairs of conductors at locations corresponding to the predetermined pattern are connected by the elastomeric conductors.

2. A key-actuated locking device comprising:

a key having a handle, a flat longitudinal main body attached to the handle, a row of closely spaced apart teeth at a distal end of the main body defining a predetermined pattern from among a plurality of possible different patterns, and orientation means carried by the main body for defining a predetermined orientation of the row of teeth;

a housing;

a longitudinal key passageway within the housing into which the key is inserted, the key passageway cooperating with the orientation means so that the row of keys have the predetermined orientation;

a plurality of pairs of separated conductors positioned in a first plane adjacent and perpendicular to an end of the key passageway and defining a row of closely spaced apart locations corresponding to possible positions of the spaced apart teeth of the key for a plurality of different possible patterns including the predetermined pattern;

an insulator sheet positioned adjacent the first plane and having a plurality of openings, each opening aligned with at least one pair of separated contacts;

a plurality of elastomeric conductors positioned adjacent the key passageway and spaced from the first plane by the insulator sheet, at least one elastomeric conductor being aligned with each of the plurality of locations defined by the pairs of separated conductors and having a first surface for receiving force supplied by a tooth of the key and a second surface for engaging and electrically connecting the pair of separated conductors with which it is aligned, the second surface being normally spaced from the pair of separated conductors by the insulator sheet when no force is applied by the key to the first surface; so that when force is applied to the first surface of the elastomeric conductor, its second surface is brought into engagement and electrical contact with the pair of separated conductors with which it is aligned, and wherein the elastomeric conductor is resilient and compressible so that application of force by the tooth which is greater than needed to bring the second surface into engagement with the pair of separated conductors causes compression of the elastomeric conductor without damage to the base, the pair of separated conductors, or the key; and means connected to the separated conductors and actuated when only the pairs of the conductors at locations corresponding to the predetermined pattern are connected by the elastomeric conductors.

3. A key-actuated locking device comprising:

a key having a handle, a flat longitudinal main body attached to the handle, a row of closely spaced apart teeth at a distal end of the main body defining a predetermined pattern from among a plurality of possible different patterns, and orientation means carried by the main body for defining a predetermined orientation of the row of teeth;

a longitudinally key passageway into which the key is inserted, the key passageway cooperating with the orientation means so that the row of teeth have the predetermined orientation;

a base positioned adjacent and perpendicular to an end of the key passageway;

a plurality of pairs of separated conductors supported by the base in a first plane and defining a plurality of closely spaced apart locations corresponding to possible positions of the spaced-apart teeth of the key for a plurality of different possible patterns including the predetermined pattern;

a plurality of closely spaced elastomeric conductors positioned between the key passageway and the first plane, defined by the pairs of separated conductors, spaced from and aligned with the plurality of locations, each elastomeric conductor having a first surface for receiving force applied by a tooth of the key and a second surface for engaging and electrically connecting one of the pairs of separated conductors; so that when force is applied to the first surface of the elastomeric conductor, its second surface is brought into engagement and electrical contact with the pair of separated conductors with which it is aligned, and wherein the elastomeric conductor is resilient and compressible so that application of force by the tooth which is greater than needed to bring the second surface into engagement with the pair of separated conductors causes compression of the elastomeric conductor without damage to the base, the pair of separated conductors, or the key;

spacer means positioned between the base and the elastomeric conductors for maintaining the second surfaces of the elastomeric conductors in spaced relationship to the pairs of separated conductors when no force is being applied to the first surfaces of the elastomeric conductors; and means connected to the conductors and actuated when only the pairs of conductors at locations corresponding to the predetermined pattern are connected by the elastomeric conductors.

4. A key-actuated locking device comprising:

a key having a handle, a flat longitudinal main body attached to the handle, a row of closely spaced apart teeth at a distal end of the main body defining a predetermined pattern from among a plurality of possible different patterns, and orientation means carried by the main body for defining a predetermined orientation of the row of teeth;

a housing;

a longitudinal key passageway within the housing into which the key is inserted, the key passageway cooperating with the orientation means so that the row of teeth have the predetermined orientation and the teeth of the key positioned at an inner end of the key passageway when the key is inserted;

a circuit board positioned generally perpendicular and adjacent to the key passageway at the inner end of the key passageway, the circuit board having a plurality of pairs of separated conductors thereon facing the inner end of the key passageway, the pairs of separated conductors defining a plurality of closely spaced apart locations corresponding to possible positions of the spaced apart teeth of the key for a plurality of different possible patterns including the predetermined pattern;

an insulator sheet positioned adjacent the circuit board and having a plurality of openings, each opening aligned with at least one pair of separated conductors;

a zebra strip positioned spaced from the circuit board by the insulator sheet with a first surface facing the end of the key passageway and a second surface facing the circuit board, the zebra strip having a plurality of elastomeric conductive strips and a plurality of elastomeric nonconductive strips adjacently abutting one another in alternating fashion, the zebra strip being aligned with the insulator strip so that at least one elastomeric conductive strip of the zebra strip is aligned with an opening in the insulator sheet and with a pair of separated conductors;

a flexible cover overlying the first surface of the zebra strip for engaging ends of the spaced apart teeth of the key when the key is inserted in the key passageway, so that force is applied by the teeth of the key when the key is inserted in the key passageway through the flexible cover to the first surface of the zebra strip, so that at least one elastomeric conductive strip of the zebra strip is deformed by the force of the two to bring the second surface of the elastomeric conductive strip into engagement with the pair of separated conductors with which it is aligned, and wherein the zebra strip is resilient and compressible so that application of force by the tooth which is greater than needed to bring the second surface into engagement with the pair of separated conductors causes compression of the zebra strip without damage to the circuit board, the pair of separated conductors, or the key; and means connected to the conductors and actuated when only the pairs of conductors at locations corresponding to a predetermined pattern are connected by the elastomeric conductors.

* * * * *